US006155745A

United States Patent [19]

Groen et al.

[11] Patent Number: 6,155,745

[45] Date of Patent: Dec. 5, 2000

[54] VEHICLE TIRE DEFLATION DEVICE

[75] Inventors: Louis M. Groen, Cincinnati, Ohio; Keith M. Knapp, Lawrenceburg, Ind.; Jerome R. Flauto, Jr., Cincinnati, Ohio; Gary L. Uthe, Fort Wright, Ky.

[73] Assignee: Stop Stick, Ltd., Lawrenceburg, Ind.

[21] Appl. No.: 09/090,782

[22] Filed: Jun. 4, 1998

[51] Int. Cl.[7] ..... E01F 13/00; E01F 16/00

[52] U.S. Cl. ..... 404/6

[58] Field of Search ..... 404/6; 256/1; 248/224.61

[56] References Cited

U.S. PATENT DOCUMENTS

| | | | |
|---|---|---|---|
| 1,075,377 | 10/1913 | Phillips . | |
| 1,094,226 | 4/1914 | Le Duc . | |
| 1,232,575 | 7/1917 | Lefort . | |
| 1,276,100 | 8/1918 | Niznik . | |
| 1,412,048 | 4/1922 | Ehringer . | |
| 1,721,978 | 7/1929 | Sherwood . | |
| 2,313,388 | 3/1943 | McDonald . | |
| 2,325,260 | 7/1943 | May . | |
| 2,346,713 | 4/1944 | Walker . | |
| 2,353,386 | 7/1944 | Bourcier . | |
| 2,438,563 | 3/1948 | Kollmeyer . | |
| 2,746,571 | 5/1956 | Taylor . | |
| 2,912,229 | 11/1959 | Persgard . | |
| 3,289,939 | 12/1966 | Martinov . | |
| 3,652,059 | 3/1972 | Groblebe . | |
| 3,993,167 | 11/1976 | Reed . | |
| 4,096,782 | 6/1978 | Deschenes . | |
| 4,360,153 | 11/1982 | Mantion et al. . | |
| 4,382,714 | 5/1983 | Hutchison . | |
| 4,473,948 | 10/1984 | Chadwick . | |
| 4,544,303 | 10/1985 | Glasmire . | |
| 4,624,601 | 11/1986 | Quittner | 404/12 |
| 4,795,093 | 1/1989 | Kozelnicky . | |
| 4,995,756 | 2/1991 | Kilgrow et al. . | |
| 5,058,843 | 10/1991 | Koster | 248/221.4 |
| 5,123,774 | 6/1992 | Dubiel . | |
| 5,253,950 | 10/1993 | Kilgrow et al. . | |
| 5,292,013 | 3/1994 | Earl | 248/73 |
| 5,322,385 | 6/1994 | Reisman . | |
| 5,330,285 | 7/1994 | Greves et al. . | |
| 5,443,225 | 8/1995 | Tracy et al. . | |
| 5,452,962 | 9/1995 | Greves . | |
| 5,482,397 | 1/1996 | Soleau . | |
| 5,498,102 | 3/1996 | Bissell . | |
| 5,507,588 | 4/1996 | Marts et al. . | |

FOREIGN PATENT DOCUMENTS 292008 10/1953 Switzerland .

OTHER PUBLICATIONS

Hovey Industries, *Letter dated Nov. 24, 1992,* 2 pages.

Stinger Spike System, Inc., *Letter dated Sep. 15, 1992,* 2 pages.

Stinger Spike System, Inc., *Brochure,* 5 pages, undated, attached to Sep. 15, 1992 letter.

The Daily Times, *Stinger device maximizes safety while halting high speed chases,* Jan. 10, 1992, 1 page.

Cornelia deBruin, *Life in the Fast Lane Proves Quite Accelerating As Boy, 9, Leads Officers On a 75–Mile Chase,* undated, 1 page, attached to a Sep. 15, 1992 letter.

(List continued on next page.)

*Primary Examiner*—Eileen D. Lillis
*Assistant Examiner*—Gary S. Hartmann
*Attorney, Agent, or Firm*—Wood, Herron & Evans, L.L.P.

[57] ABSTRACT

A multiple use vehicle tire deflation device comprises a base, at least one cartridge removably secured to the base, and at least one vehicle tire deflating quill removably secured to the cartridge. The base, cartridge and quill are configured such that the quill, when imbedded by a vehicle tire rolling over the device, separates from the cartridge, whereas the cartridge remains secured to the base yet is readily removably replaceable. A replacement cartridge for a vehicle tire deflation device, which device includes a base, comprises a block, at least one tire deflating quill removably secured to the block, and structure on the block adapted to cooperate with the base of the tire deflation device to facilitate installation and removal of the block onto and from the base and to prevent the block from separating from the base when the quill becomes embedded in a vehicle tire rolling over the device.

5 Claims, 3 Drawing Sheets

OTHER PUBLICATIONS

Unknown, *High–speed chase ends with four flats,* undated, 1 page, attached to Sep. 15, 1992 letter.

The Ottawa Citizen, "*Man Arrested After Car Chase*", Monday, May 6, 1991, 1 page.

Edgar Brothers, *Letter dated Apr. 21, 1991*, 1 page.

Hovey Industries, *"Hollow Spike Belt*", undated, 2 pages, attached to Nov. 24, 1992 letter.

Cpl W.W. Reid, New Glasgow Highway Patrol, *Hollow–Spike Belt Acquits Itself Well*, 3 pages, 1979.

Insp. M.G. Markell, Division Traffic Officer, Edmonton, Alberta, *Spike Belts—A Suitable Alternate To High Speed Pursuits*, 2 pages, 1984.

Inspector Ralph L. DeGroot, Canadian Embassy, Washington, D.C., *The Hollow Spike Strip: An Improved Vehicle Stopping Device*, 7 pages, 1981.

California Highway Patrol, *Hollow Spike Strip Study*, 13 pages, 1986.

Sherwood International Export Corporation, *Road Spikes System—Operational Instructions*, 2 pages, undated, attached to Nov. 24, 1992 letter.

VEHICLE TIRE DEFLATION DEVICE

FIELD OF THE INVENTION

This invention relates generally to law enforcement equipment, and more particularly to devices of the type employed by law enforcement to deflate the tires of a vehicle pursued by or attempting to flee law enforcement.

BACKGROUND OF THE INVENTION

So-called tire deflation devices are being placed in greater use by the law enforcement community. Such devices typically include a base and a plurality of tire deflating spikes or quills removably secured to the base. When a tire of a vehicle pursued by law enforcement rolls over the device, quills are embedded in the tire and pulled free from the base. The spikes or quills cause the tire to deflate, thus immobilizing the vehicle and hence the fleeing suspect. The quills may be hollow to accelerate deflation of the tires. Two such devices are disclosed in U.S. Pat. Nos. 5,330,285 and 5,452,962, assigned to the assignee of the present invention, and hereby incorporated by reference herein as if fully set forth in their entirety.

One disadvantage of tire deflation devices of the type described above is that they are generally "single use" devices. That is to say, once a vehicle has run over the device, the device is generally not reusable since a number of the quills have usually been pulled out by the vehicle's tire and because reinstallation of quills onto the base is tedious, time consuming and not efficiently performed in the field.

It would therefore be desirable to provide a multiple use vehicle tire deflation device, i.e. one which, after it has been run over by a vehicle, can be quickly serviced to replace the "spent" spikes or quills with new ones. Accomplishing this would avoid the cost of having to scrap the whole device after it has been used once, thereby allowing law enforcement to get multiple usages out of a single device, and consequently reducing the effective cost of the device to law enforcement.

SUMMARY OF THE INVENTION

The present invention is a multiple use vehicle tire deflation device. The device comprises a base, at least one cartridge removably secured to the base, and at least one vehicle tire deflating quill removably secured to the cartridge. The base, cartridge and quill are configured such that the quill, when imbedded in a vehicle tire rolling over the device, separates from the cartridge, whereas the cartridge remains secured to the base yet is readily removably replaceable.

The cartridge is preferably slidably received by the base. The base preferably is elongated and has opposed ends; the cartridge is slid on to the base from one of the opposed ends. The base and cartridge preferably include cooperating dovetail structure slidingly retaining the base and cartridge together.

The base preferably includes an end cap removably secured to each opposed end retaining the cartridge on the base. Each end cap preferably includes a curved portion and a flat portion. The flat portion is perpendicular to the quill. The device is thereby operable to upright itself when placed on a road surface on the curved portions by rolling thereon until coming to rest on the flat portions when the flat portions contact the road surface.

The quill is preferably removably retained in a bore in the cartridge. The cartridge preferably includes a groove therein and a filament disposed in the groove. The quill preferably includes a hole in at least one side thereof with the filament passing through the hole in the quill to thereby removably retain the quill in the cartridge.

The cartridge preferably includes a collapsible, protective cover extending over the quill. The cartridge further preferably includes a groove on each side thereof. The cover has a pair of ends and a respective cover end is retained in a respective cartridge groove.

In the case of moving vehicles being pursued by law enforcement, it is preferred that a plurality of cartridges be used with a base, with at least one vehicle tire deflating quill being removably secured to each cartridge. In the case of stationary vehicles which law enforcement wishes to prevent being utilized as escape vehicles, only one cartridge is preferably used with a base, with two vehicle tire deflating quills being removably secured to the cartridge.

Another aspect of the invention is a replacement cartridge for a vehicle tire deflation device, which device includes a base. The replacement cartridge comprises a block, at least one tire deflating quill removably secured to the block, and structure on the block adapted to cooperate with the base of the tire deflation device to facilitate installation and removal of the block onto and from the base and to prevent the block from separating from the base when the quill becomes embedded in a vehicle tire rolling over the device.

The structure of the block preferably includes a portion of a dove-tail sliding joint. The quill is preferably removably retained in a bore in the block. The block preferably includes a groove therein and a filament disposed in the groove, and the quill preferably includes a hole in at least one side thereof with the filament passing through the hole in the quill to thereby removably retain the quill in the block. The block also preferably includes a collapsible, protective cover extending over said quill. The block further preferably includes a groove on each side thereof; the cover has a pair of ends and a respective cover end is retained in a respective block groove.

The tire deflation device of this invention therefore provides the capability of obtaining multiple uses out of a single device. After the device has been used to stop the vehicle of a fleeing suspect, an officer need only remove one of the end caps of the device, slide the "spent" cartridges, i.e. the cartridges from which quills have been pulled free and become embedded in the vehicle tire, off of the base, slide "fresh" cartridges with quills attached onto the base and reattach the end cap to the base. Thus there is no need to discard the device after its first use. By maintaining a supply of replacement cartridges on hand the device should be able to be reused a number of times before having to be discarded.

These and other advantages of the present invention will become readily apparent during the following detailed description taken in conjunction with the drawings herein, in which:

DETAILED DESCRIPTION OF THE INVENTION

Figure 1:
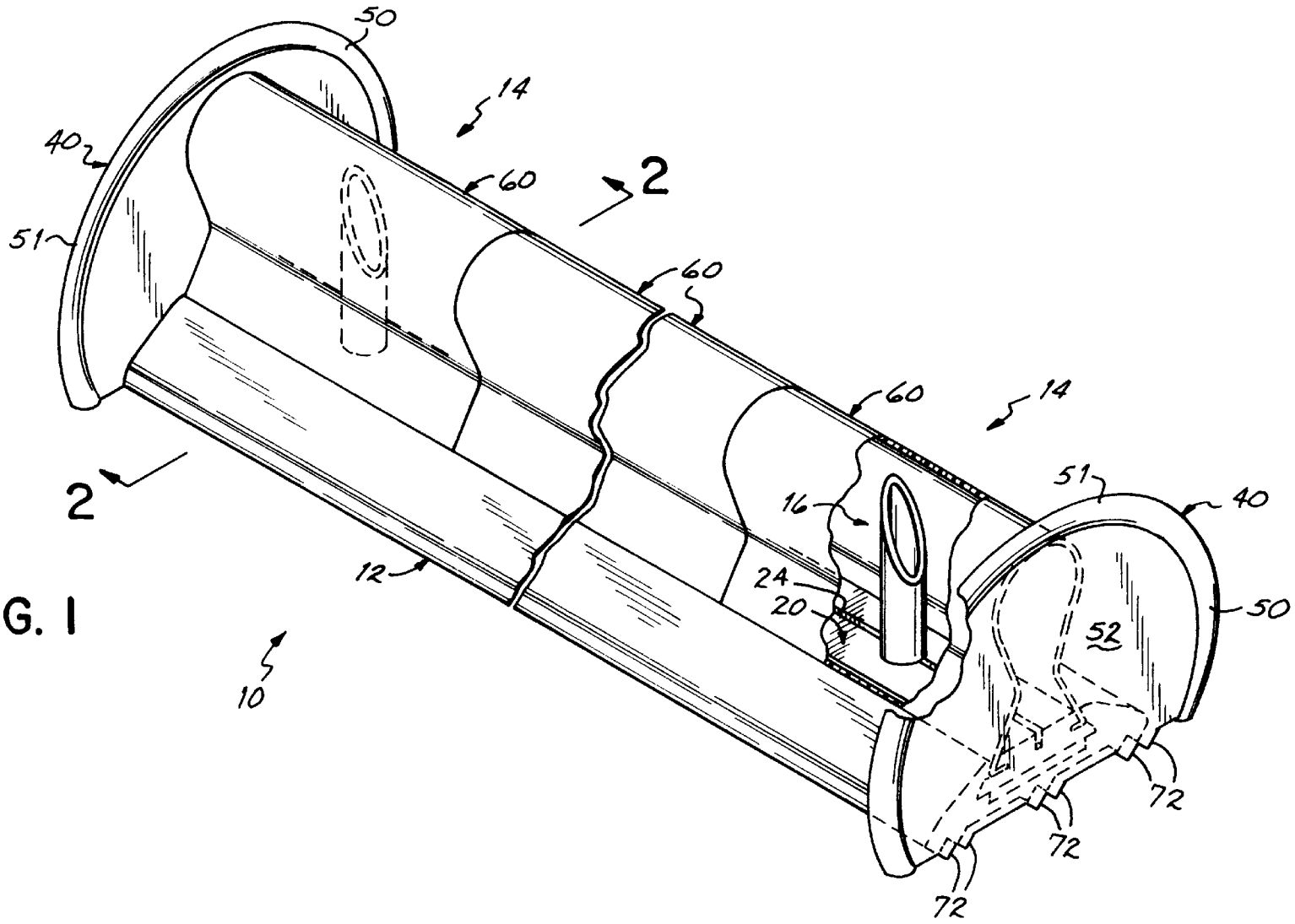
FIG. 1 is a perspective view of the vehicle tire deflation device of the present invention.
Figure 2:
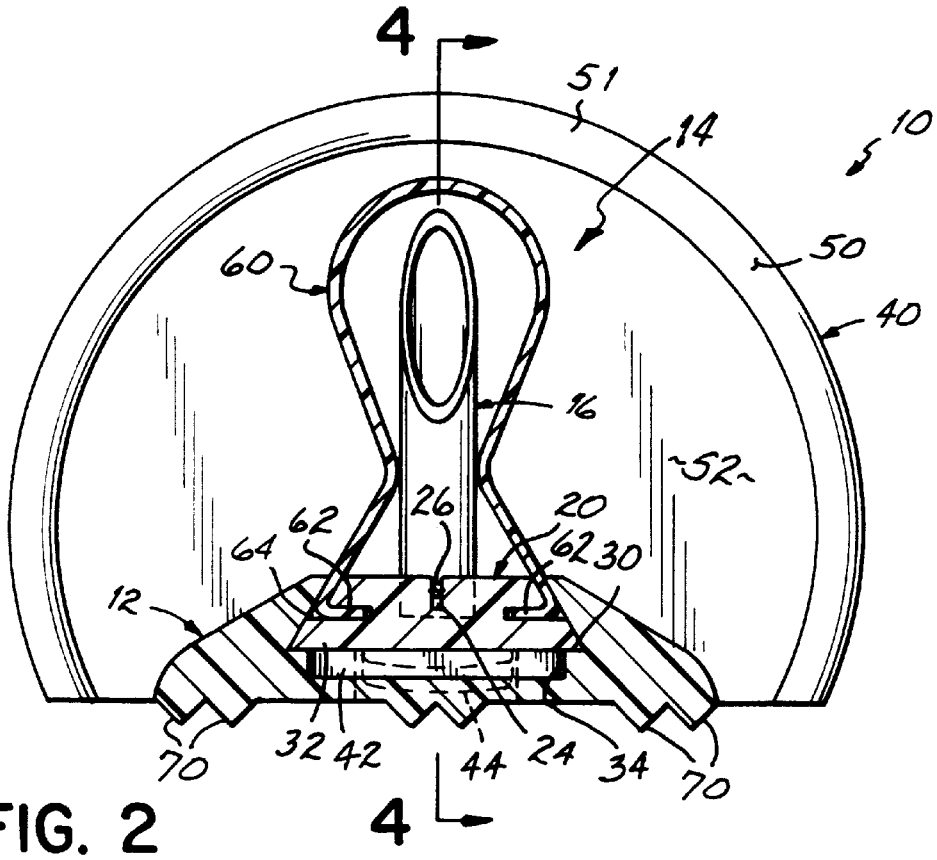
FIG. 2 is a view taken along line 2—2 of FIG. 1.
Figure 4:
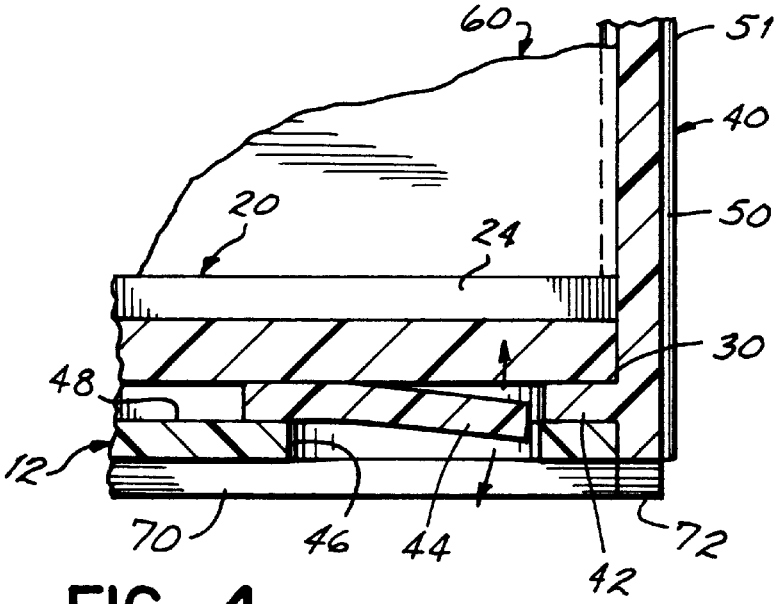
FIG. 4 is a view taken along line 4—4 of FIG. 2.
Figure 3:
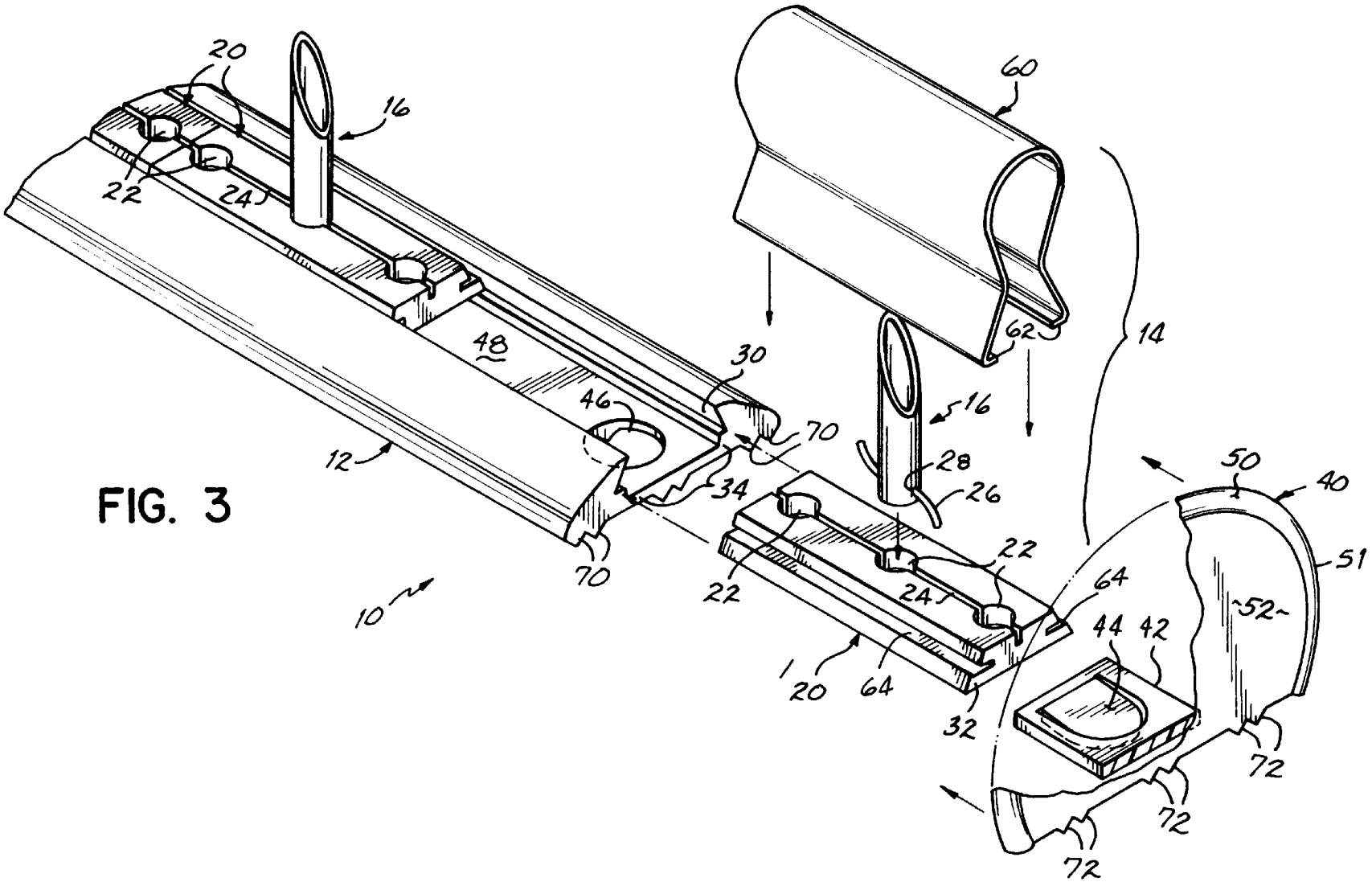
FIG. 3 is an exploded perspective view of one end of the device of FIGS. 1 and 2.

Referring first to FIG. 1, there is illustrated a vehicle tire deflation device 10 according to this invention. Referring to FIGS. 1–3, the device 10 includes a base 12 and a plurality of cartridges 14 removably secured to the base 12. The cartridges 14 each include at least one quill 16. As will be described in more detail subsequently, the base 12, cartridges 14 and quills 16 are configured such that the quills 16, when imbedded in a vehicle tire rolling over the device 10, will separate from their respective cartridges 14, whereas the cartridges 14 will remain secured to the base 12. However, the cartridges 14 from which quills 16 have been withdrawn are readily removed from the base 12 and replaced with new cartridges 14 including quills 16, as will be subsequently described.

Referring still to FIGS. 1–3, it will be seen that each cartridge 14 includes a block 20 which includes a plurality of bores 22 therein, the bores 22 being sized to each accept a respective quill 16. Bores 22 are preferably nominally 0.375 inch in diameter and 0.218 inch deep; quills 16 are preferably ⅜ inch O.D., 20 gauge tubing 2.031 inches long. In addition, the block 20 includes a longitudinal groove 24 therein. The groove 24 is preferably 0.050 inch wide and 0.170 inch deep, being rectangular in cross-section. The groove 24 receives a filament 26 which passes through a pair of holes in a quill 16, one of which is shown at 28, and removably retains the quills 16 within the bores 22.

Base 12 and block 20 include cooperating dovetail structure permitting the blocks 20 to be slid onto the base 12 from one end thereof toward the other end thereof. More particularly, base 12 includes a female dovetail portion 30 and the blocks 20 include a male dovetail portion 32. Thus, while readily inserted onto and removed from the base 12, the cartridges 20 are completely secured to the base 12 and will not separate from the base 12 when a tire rolls over the device 10 and imbeds quills 16 therein.

The device 10 includes a pair of collapsible end caps 40. The end caps 40 are collapsible to prevent a vehicle tire from "ramping over" an otherwise rigid cap and thereby avoiding the quills 16. The end caps 40 are removably secured to each opposed end of the base 12. More particularly, each end cap 40 includes a tab 42 which includes a downwardly directed resilient semicircular tang 44 which snaps into a bore 46 in the bottom surface 48 of the base 12. The tab 42 slides underneath the block 20 within a rectangular in cross-section area 34 below female dovetail portion 30.

Each end cap 40 includes a curved portion 50 and a generally flat portion 52. The curved portion 50 includes a round bead 51 therearound which provides a hand hold for handling the device. The flat portion 52 is generally perpendicular to the longitudinal axis of the quills 16, with the points of the quills 16 pointing away from the flat portion 52. Thus, device 10 is operable to upright itself when placed on a road surface on the curved portions 50 by rolling on the curved portions 50 until coming to rest on the flat portions 52 when the flat portions 52 contact the road surface. As can be seen from the Figures, the center of gravity of the device 10 is much closer to the flat portion 52 than the curved portion 50, due to the weight of the base 12. Hence, the device readily rolls on the curved portions 50 until coming to rest on the flat portions 52 with the quills 16 pointing upward in a tire penetrating direction.

As a protective measure, each cartridge 14 includes a collapsible, protective cover 60. The covers 60 are collapsible so that a vehicle tire running over the device 10 will collapse the covers 60 and embed quills 16 therein. Each cover 60 includes a pair of ends 62 which are inwardly directed; the ends 62 slide into grooves 64 on either lateral side of the block 20, and protect the user from the quills 16.

To aid in gripping a road surface, the base 12 and end caps 40 may include pointed, downwardly projecting ribs 70 and 72, respectively.

With respect to preferable materials, the base 12 is preferably of ABS extruded grade plastic. The quills 16 are preferably of CDS 1026 seamless tubing, Teflon coated. The blocks 20 are preferably of 30% glass filled polypropylene. The filaments 26 are preferably nylon trimmer string, 0.050 inch in diameter by 1 inch in length. The lower ends of the quills 16, as well as the bores 22 in the cartridges 14, are preferably lubricated with Lubri-Film Heavy Duty Sanitary Spray, available from Hanes Manufacturing Company, West Lake, Ohio. The covers 60 are preferably of extruded polypropylene. The end caps 40 are preferably of thin, soft plastic.

In use, the device 10 is placed on a road surface. Due to the nature of the end caps 40, if time is of the essence, the device 10 need merely be tossed onto the road surface, and the device 10 will right itself, rolling on the curved portions 50 of end caps 40 until assuming a stationery position on the flat portions 52. Once a tire of the pursued vehicle rolls over the device 10, one or more quills 16 will become imbedded in those tires and will pull free of the blocks 20. The blocks 20 from which the quills 16 have been pulled free will nevertheless remain secured to base 12. After use, a law enforcement officer need merely push the resilient tang 44 of one of the end caps 40 upwardly and remove that end cap 40 from the base 12, slide off of the base 12 the "spent" cartridges 14, i.e. the cartridges which have had their covers 60 collapsed and their quills 16 separated therefrom, and slide onto the base 12 "fresh" cartridges 14 that have quills 16 attached and covers 60 thereover. The officer then need merely replace the end cap 40 back onto the end of the base 12 and the device 10 is ready for reuse.

Those skilled in the art will readily recognize numerous adaptations and modifications which can be made to the present invention which will result in an improved vehicle tire deflation device, yet all of which will fall within the spirit and scope of the present invention as defined in the following claims. For example, the device of the invention can be utilized to deflate the tires of a fleeing vehicle, as well as utilized placed behind the tires of a stationary vehicle to prevent the stationary vehicle from being employed as an escape vehicle during, for example, the serving of a felony arrest warrant or drug raid. For use in deflating the tires of fleeing vehicles, the device is preferably configured with cartridges which include only 1 quill each, and 7–10 cartridges per base. For use in placing behind the tires of a stationary vehicle, the device is preferably configured with cartridges which include two quills each, and 1 cartridge per base. Accordingly, the invention is to be limited only by the scope of the following claims and their equivalents.

What is claimed is:

1. A vehicle tire deflation device comprising:

a base;

at least one cartridge removably secured to said base; and at least one vehicle tire deflating quill removably secured to said at least one cartridge;

said base, cartridge and quill being configured such that said quill, when embedded in a vehicle tire rolling over said device, separates from said cartridge, whereas said cartridge remains secured to said base yet is readily removably replaceable;

wherein said cartridge is slidingly received by said base;

wherein said base is elongated and has opposed ends and wherein said cartridge is slid onto said base from one of said opposed ends;

wherein said base and cartridge include cooperating dove-tail structure slidinqly retaining said base and cartridge together;

wherein said base includes an end cap removably secured to each said opposed end retaining said cartridge on said base; and wherein each said end cap includes a curved portion and a flat portion, said flat portion being perpendicular to said quill, said device thereby being operable to upright itself when placed on a road surface on said curved portions by rolling thereon until coming to rest on said flat portions when said flat portions contact the road surface.

2. A vehicle tire deflation device comprising:

a base;

at least one cartridge removably secured to said base; and at least one vehicle tire deflating quill removably secured to said at least one cartridge;

said base, cartridge and quill being configured such that said quill, when embedded in a vehicle tire rolling over said device, separates from said cartridge; whereas said cartridge remains secured to said base yet is readily removably replaceable:

wherein said quill is removably retained in a bore in said cartridge; and wherein said cartridge includes a groove therein and a filament is disposed in said groove, and said quill includes a hole in at least one side thereof and said filament passes through said hole in said quill to thereby removably retain said quill in said cartridge.

3. A vehicle tire deflation device comprising:

a base;

a plurality of cartridges; and at least one vehicle tire deflating quill removably secured to each said cartridge;

said base and each of said cartridges including cooperating dove-tail structure whereby said cartridges are slidably retained on said base;

whereby when a vehicle tire rolls over said device and certain ones of said quills are embedded in the tire, said certain ones of said quills separate from respective ones of said cartridges, and remaining ones of said cartridges remain secured to said base; and wherein said base includes an end cap removably secured to each said end retaining said cartridges on said base, each said end cap including a curved portion and a flat portion, said flat portion being perpendicular to said quills, said device thereby being operable to upright itself when placed on a road surface on said curved portions by rolling thereon until coming to rest on said flat portions when said flat portions contact the road surface.

4. A vehicle tire deflation device comprising:

a base;

a plurality of cartridges; and at least one vehicle tire deflating quill removably secured to each said cartridge;

said base and each of said cartridges including cooperating dove-tail structure whereby said cartridges are slidably retained on said base;

whereby when a vehicle tire rolls over said device and certain ones of said quills are embedded in the tire said certain ones of said quills separate from respective ones of said cartridges, and remaining ones of said cartridges remain secured to said base; and wherein said quill is removably retained in a bore in said cartridge, said cartridge includes a groove therein and a filament is disposed in said groove, and said quill includes a hole in at least one side thereof, and said filament passes through said hole in said quill to thereby removably retain said quill in said cartridge.

5. A replacement cartridge for a vehicle tire deflation device, the deflation device including a base, said replacement cartridge comprising:

a block;

at least one tire deflating quill removably secured to said block; and structure on said block adapted to cooperate with the base of the tire deflation device to facilitate installation and removal of said block onto and from the base and to prevent said block from separating from the base when said quill becomes embedded in a vehicle tire rolling over the device;

wherein said quill is removably retained in a bore in said block; and wherein said block includes a groove therein and a filament disposed in said groove, and said quill includes a hole in at least one side thereof and said filament passes through said hole in said quill to thereby removably retain said quill in said block.

* * * * *

UNITED STATES PATENT AND TRADEMARK OFFICE

CERTIFICATE OF CORRECTION

PATENT NO. : 6,155,745
DATED : December 5, 2000
INVENTOR(S) : Louis M. Groen et al.

It is certified that error appears in the above-identified patent and that said Letters Patent is hereby corrected as shown below:

Column 5,
Line 2, “structure slidinqly retaining” should read -- structure slidingly retaining --
Line 24, “removably replaceable:” should read -- removably replaceable; --

Column 6,
Line 17, “in the tire said” should read -- in the tire, said --

Signed and Sealed this

Twenty-sixth Day of April, 2005

JON W. DUDAS
*Director of the United States Patent and Trademark Office*